US005352997A

United States Patent [19]

Särkkä

[11] Patent Number: 5,352,997

[45] Date of Patent: Oct. 4, 1994

[54] DIELECTRIC RESONATOR STRUCTURE HAVING RESONATOR DISPLACEABLE BETWEEN SUPPORT PLATES FOR ADJUSTING RESONANCE FREQUENCY

[75] Inventor: Veli-Matti Särkkä, Oulunsalo, Finland

[73] Assignee: Nokia Telecommunications OY, Espoo, Finland

[21] Appl. No.: 960,396

[22] PCT Filed: May 5, 1992

[86] PCT No.: PCT/FI92/00144

§ 371 Date: Jan. 7, 1993

§ 102(e) Date: Jan. 7, 1993

[87] PCT Pub. No.: WO92/20115

PCT Pub. Date: Nov. 12, 1992

[30] Foreign Application Priority Data

May 9, 1991 [FI] Finland ..... 912257

[51] Int. Cl.[5] ..... H01P 7/10

[52] U.S. Cl. ..... 333/219.1; 333/235

[58] Field of Search ..... 333/202, 219, 219.1, 333/234, 235; 331/96, 107 DP, 117 D

[56] References Cited

U.S. PATENT DOCUMENTS 4,319,208 3/1982 de Bayser et al. ..... 333/204
4,661,790 4/1987 Gannon et al. ..... 333/202 X
4,956,617 9/1990 Bowlds ..... 331/96
5,008,640 4/1991 Accatino et al. ..... 333/219.1
5,027,090 6/1991 Gueble et al. ..... 333/219.1 X

FOREIGN PATENT DOCUMENTS 0296009 12/1988 France .

OTHER PUBLICATIONS

S. J. Fiedziusko, "Microwave Dielectric Resonators", Microwave Journal, Sep. 1986, pp. 189–198.

M. W. Pospieszalski, "Cylindrical Dielectric Resonators and their Applications in Tem Line Microwave Circuits", IEEE Transactions on Microwave Theory and Techniques, vol. MIT-27, No. 3, Mar. 1979, pp. 233–238.

Gundolf Kuchler, "Ceramic Resonators for Highly Stable Oscillators", Engineering, Siemens Components, XXIV, 1989 No. 5, pp. 180–183.

*Primary Examiner*—Seungsook Ham

*Attorney, Agent, or Firm*—Cushman, Darby & Cushman

[57] ABSTRACT

A dielectric resonator structure includes a resonator made of a dielectric material. The resonator is supported between two support plates and can be displaced at least in one direction between the plates. At least one of the plates is made of a dielectric material so that the amount of the dielectric material of the support plate varies in the direction of displacement of the resonator.

12 Claims, 1 Drawing Sheet

DIELECTRIC RESONATOR STRUCTURE HAVING RESONATOR DISPLACEABLE BETWEEN SUPPORT PLATES FOR ADJUSTING RESONANCE FREQUENCY

FIELD OF THE INVENTION

The invention relates to a dielectric resonator structure comprising a resonator made of a dielectric material.

BACKGROUND OF THE INVENTION

Among high-frequency and microwave resonator structures, so-called dielectric resonators have recently become increasingly interesting as they offer e.g. the following advantages over conventional resonator structures: smaller circuit sizes, higher integration level, higher efficiency and lower cost of manufacture. Any element having a simple geometric shape and being made of a material of low dielectric losses and a high relative dielectric constant can be used as a high-Q dielectric resonator. For reasons of the manufacturing technique the dielectric resonator is usually cylindrical, such as a cylindrical disc.

The structure and operation of dielectric resonators are described e.g. in the following articles:

[1] *Ceramic Resonators for Highly Stable Oscillators*, Gundolf Kuchler, Siemens Components XXIV (1989) No. 5, p. 180–183.

[2] *Microwave Dielectric Resonators*, S. Jerry Fiedziuszko, Microwave Journal, September 1986, p. 189–191.

[3] *Cylindrical Dielectric Resonators and their Applications in TEM Line Microwave Circuits*, Marian W. Pospieszalski, IEEE Transactions on Microwave Theory and Techniques, VOL. MTT-27, No. 3, March 1979, p. 233–238.

The resonance frequency of the dielectric resonator is primarily determined by the dimensions of the resonator element. Another factor affecting the resonance frequency is the surroundings of the resonator. The electric or magnetic field of the resonator and thus the resonance frequency can be intentionally affected by introducing a metal surface or any other conductive surface in the vicinity of the resonator. To adjust the resonance frequency of the dielectric resonator, a common practice is to adjust the distance between the conductive metal surface and the planar surface of the resonator. The adjusting mechanism may be e.g. an adjustment screw attached to the housing surrounding the resonator.

In this kind of adjusting method, however, it is typical that the resonance frequency varies non-linearly as a function of the adjusting distance. Due to the non-linearity and the steepness of the adjustment, it is difficult and requires high precision to accurately adjust the resonance frequency, especially in the upper end of the adjusting range. In addition, the unloaded Q-factor varies as a function of the distance between the conductive surface and the resonator.

A constant Q-factor and more linear frequency adjustment can be obtained within a wider range by replacing the conductive adjustment surface or plate with a dielectric adjustment plate the distance of which from the planar surface of the resonator is adjusted. FIG. 7 in the above-mentioned article [2] shows a so-called double resonator structure as a modification of this solution. In the double resonator structure, two cylindrical dielectric resonator discs are positioned co-axially close to each other so that the distance between their planar surfaces can be adjusted by displacing the discs in the direction of their common axis. Also in this case the adjustment curve is still steep, in addition to which the double resonator structure is larger and more complicated than a conventional structure utilizing an adjustment plate.

SUMMARY 0F THE INVENTION

The object of the invention is to provide a dielectric resonator structure in which the resonance frequency can be adjusted more accurately than was previously possible.

This is achieved by means of the dielectric resonator structure according to the invention, wherein the resonator is supported between two support plates and displaceable at least in one direction between the support plates, at least one of the support plates being made of a dielectric material so that the amount of the dielectric material of the dielectric support plate varies in a direction of displacement of the resonator.

The basic idea of the invention is that the resonance frequency is adjusted by varying the amount of dielectric material in the vicinity of the resonator by moving the resonator in place of the frequency adjuster. In the preferred embodiment of the invention, the resonator disc is attached and supported by means of dielectric support plates at least one of which comprises an opening of a predetermined shape. The adjustment of the resonance frequency of the resonance circuit takes place by moving the resonator with respect to the form openings of the support plates, so that the amount of the ceramic material adjusting the resonance frequency varies in the vicinity of the resonator as a function of the adjusting movement. The invention provides a simpler and more compact structure, since the separate frequency adjustment and support structures are omitted. As all the structures can be made of a dielectric material, temperature compensation will be facilitated and the Q-factor of the resonator remains constant during the frequency adjustment. By suitably selecting the size/shape of the form openings, a resonance frequency adjustment curve having a desired slope and linearity is achieved. The gently sloping, linear adjustment curve, in turn, results in better accuracy.

BRIEF DESCRIPTION OF THE DRAWINGS

In the following the invention will be described in greater detail by means of illustrating embodiments with reference to the attached drawings, in which.

DETAILED DESCRIPTION

Figure 1A:
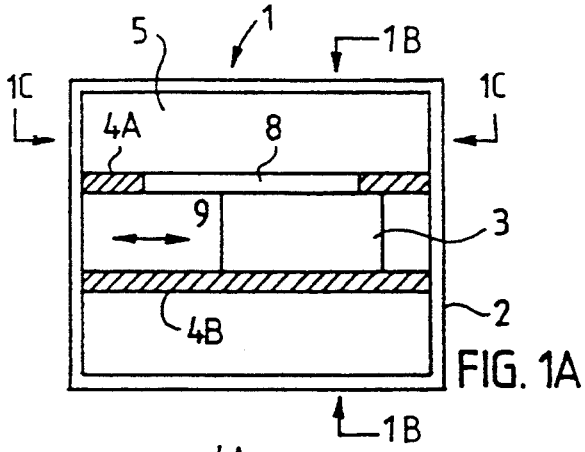
FIG. 1A shows a cross-sectional side view of a resonator structure according to the invention.

As used herein, the term dielectric resonator refers generally to any body or element of a suitable geometric shape and made of a material of low dielectric losses and having a high relative dielectric constant. For reasons of manufacturing technique, the dielectric resonator is usually cylindrical, such as a cylindrical disc. The most commonly used material is ceramic.

The structure, operation and ceramic materials of dielectric resonators are described e.g. in the above-mentioned articles [1], [2] and [3], which are incorporated in the present application for reference. In the text below the structure of the dielectric resonator will be described only to such an extent as is necessary for the understanding of the invention.

The figures show a cross-section of a dielectric resonator structure 1 according to the preferred embodiment of the invention, comprising a dielectric, cylindrical resonator element 3 positioned in a cavity 5 defined by a housing 2 made of an electrically conductive material (such as metal). The housing 2 is connected to ground potential. The dielectric resonator element 3, typically made of a ceramic material, is supported between two parallel support plates 4A and 4B at a fixed distance from the bottom and cover of the housing 2. The lower surface of the upper support plate 4A is pressed against the upper radial planar surface of the cylindrical resonator disc 3 while the upper surface of the lower support plate 4B is correspondingly pressed against the lower planar surface of the resonator disc 3, so that the resonator disc 3 is radially displaceable between the support plates 4A and 4B. The lower and upper surfaces of the support plates 4A and 4B are preferably provided with recesses or grooves 7 having a width equal to the diameter of the resonator disc 3. The resonator disc 3 is positioned in the recesses or grooves, which determine the direction of movement of the disc 3, indicated by the arrow 9.

Figure 2A:
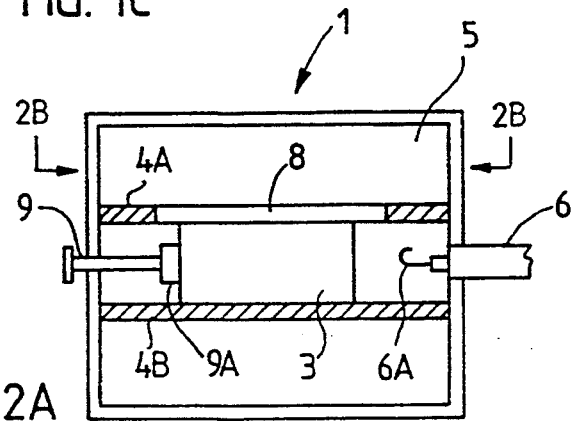
FIG. 2A shows the resonator structure of FIG. 1A when the resonator has been displaced.

The electromagnetic fields of the dielectric resonator extend outside the resonator element, and so the resonator can be electromagnetically connected to another resonator circuit in various ways, depending on the application, such as by a microstrip conductor, a bent coaxial conductor, or a conventional straight conductor positioned close to the dielectric resonator. In the example of FIG. 2A, the connection to the resonator 3 is made by means of a bent inner conductor 6A of a coaxial cable 6.

The resonance frequency of the dielectric resonator is determined mainly by the dimensions of the resonator element. Another factor affecting the resonance frequency is the surroundings of the resonator. By introducing a metal surface or some other conductive surface in the vicinity of the resonator, the electric or magnetic field of the resonator and thus also the resonance frequency can be intentionally affected. A similar effect is produced when a dielectric body is brought close to the resonator except that the unloaded Q-factor of the resonator does not vary in this case.

Figure 1B:
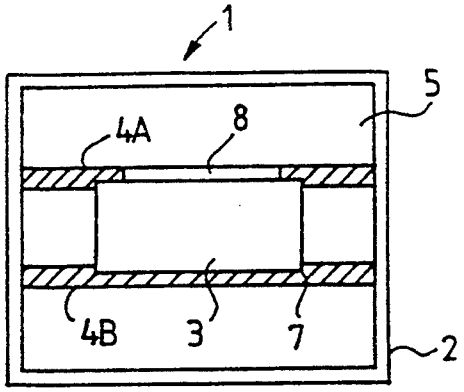
FIGS. 1B and 1C show sections taken along the lines 1—1B and 1C—1C, respectively, of the resonator structure of FIG. 1A.
Figure 1C:
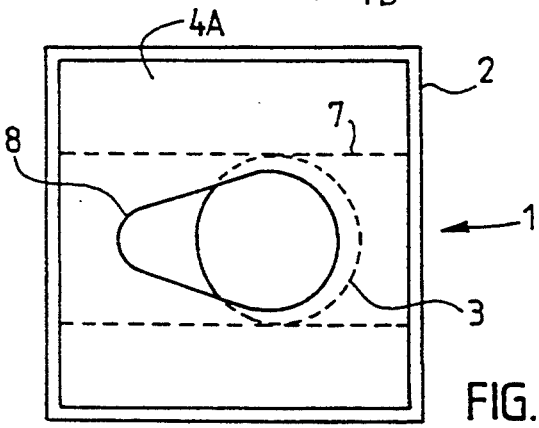
Figure 2B:
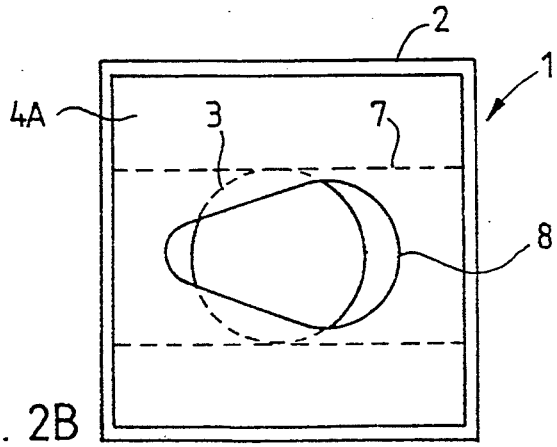
FIG. 2B shows a section taken along the line 2B—2B of the resonator structure of FIG. 2A.

In the resonator structure 1 according to the invention, at least one of the support plates 4A and 4B is made of a suitable dielectric material so that it affects the resonance frequency of the resonator 3. The support plate 4A is provided with a form opening 8 the shape and size of which vary in the direction of displacement of the resonator disc 3. The form opening 8 also causes the amount of the dielectric material in the immediate vicinity of the resonator disc 3 to vary in the direction of displacement of the resonator disc 3, which, in turn, varies the resonance frequency. By suitably selecting the size and shape of the form opening 8, a desired interdependence can be achieved between the linear movement (location in the direction of movement) of the resonator disc 3 and the resonance frequency. FIGS. 2A–2B show the resonator structure when the resonator disc has been displaced in the direction indicated by the arrow 9 to the left from the position shown in FIGS. 1A–1C.

Alternatively, the support plates 4A and 4B can both be ceramic and both of them may comprise form openings 8. From the point of view of temperature compensation, it is preferable that the support plates 4A and 4B are both dielectric.

The adjusting mechanism may, for instance, comprise an adjusting screw or rod 9 attached to the edge of the resonator disc 3 by means of an insulator spacer 9A, as shown in FIG. 2A.

The invention has been described above by way of example by means of a specific embodiment. As is obvious to one skilled in the art on the basis of the above, the adjusting principle according to the invention can, however, be applied in all dielectric resonator structures in place of conventional adjusting methods. A few examples of possible structures are given in the above-mentioned articles [1]–[3].

The figures and the description related to them are only intended to illustrate the present invention. In its details the resonator structure according to the invention may vary within the spirit and scope of the attached claims.

I claim:

1. A dielectric resonator structure, comprising:

a resonator made of a dielectric material;

a pair of two spaced apart but confronting support plates, said resonator being supported between said plates;

means for displacing said resonator between said support plates, in at least one direction that is parallel to said support plates;

at least one of said support plates being made of a dielectric material and having an opening provided therethrough, the width of said opening crosswise of said direction varying in said direction if relative to said resonator as a result of said resonator being displaced in said direction by said means for displacing.

2. The resonator structure of claim 1, wherein:

both of said support plates are made of a dielectric material.

3. The resonator structure of claim 2, wherein:

both of said support plates have a respective said opening, the width of each said opening crosswise of said direction varying in said direction of displacement of said resonator.

4. The resonator structure of claim 1, further including:

a cavity defined by a housing made of an electrically conductive material;

said resonator and support plates being housed in said cavity.

5. The resonator structure of claim 2, further including:

a cavity defined by a housing made of an electrically conductive material;

said resonator and support plates being housed in said cavity.

6. The resonator structure of claim 3, further including:

a cavity defined by a housing made of an electrically conductive material;

said resonator and support plates being housed in said cavity.

7. The resonator structure of claim 1, wherein: said resonator is made of a ceramic material.

8. The resonator structure of claim 2, wherein: said resonator is made of a ceramic material.

9. The resonator structure of claim 3, wherein: said resonator is made of a ceramic material.

10. The resonator structure of claim 1, wherein: said resonator is a cylindrical disk.

11. The resonator structure of claim 2, wherein: said resonator is a cylindrical disk.

12. The resonator structure of claim 3, wherein: said resonator is a cylindrical disk.

* * * * *